US010244881B2

(12) United States Patent
Judkins

(10) Patent No.: US 10,244,881 B2
(45) Date of Patent: Apr. 2, 2019

(54) DRAPE HAVING STABILIZER

(71) Applicant: Ren Judkins, Pittsburgh, PA (US)

(72) Inventor: Ren Judkins, Pittsburgh, PA (US)

(73) Assignee: Hunter Douglas Inc., Pearl River, NY (US)

( * ) Notice: Subject to any disclaimer, the term of this patent is extended or adjusted under 35 U.S.C. 154(b) by 171 days.

(21) Appl. No.: 14/830,151

(22) Filed: Aug. 19, 2015

(65) Prior Publication Data

US 2016/0051075 A1 Feb. 25, 2016

Related U.S. Application Data

(60) Provisional application No. 62/039,211, filed on Aug. 19, 2014.

(51) Int. Cl.

| | |
|---|---|
| ***A47H 13/16*** | (2006.01) |
| ***A47H 13/02*** | (2006.01) |
| ***A47H 1/02*** | (2006.01) |
| ***A47H 1/022*** | (2006.01) |

(52) U.S. Cl.

CPC ..... *A47H 13/16* (2013.01); *A47H 1/02* (2013.01); *A47H 1/022* (2013.01); *A47H 13/02* (2013.01); *A47H 2001/0215* (2013.01)

(58) Field of Classification Search

CPC . A47H 5/03; A47H 1/02; A47H 13/14; A47H 13/16; A47H 23/00; A47H 2201/01; A47H 23/08; A47H 1/022; E06B 9/36; E06B 9/367; E06B 9/06; E06B 9/0692; E06B 9/0669

See application file for complete search history.

(56) References Cited

U.S. PATENT DOCUMENTS

| | | | | |
|---|---|---|---|---|
| 3,643,288 | A * | 2/1972 | Olivari | A47H 1/022 16/95 D |
| 4,582,109 | A * | 4/1986 | Fairbanks | A47H 13/14 160/348 |
| 4,915,153 | A * | 4/1990 | Toti | A47H 1/04 160/330 |
| 5,170,531 | A * | 12/1992 | Ryan | A47H 5/03 16/87.2 |
| 5,765,260 | A * | 6/1998 | Judkins | A47H 13/14 16/93 D |
| 5,857,511 | A | 1/1999 | Judkins | |
| 6,318,440 | B1 * | 11/2001 | Cordrey | A47H 23/10 160/124 |
| 2006/0037721 | A1 * | 2/2006 | Zahner | A47H 13/02 160/330 |

(Continued)

*Primary Examiner* — Katherine W Mitchell
*Assistant Examiner* — Jeremy C Ramsey
(74) *Attorney, Agent, or Firm* — Buchanan Ingersoll & Rooney PC

(57) ABSTRACT

A drape has a longitudinal pocket on one or both sides of the drape. A stabilizer is placed within the pocket and extends the length of the pocket. The stabilizer is supported by a drapery support such as a rod or track in a manner which enables the panel to move along the drapery support from a closed, drawn position to an open, stacked position. The stabilizer is supported by the drapery support and is free to move within the pocket. The stabilizer prevents the drape from flaring at the bottom. A wand may be attached to the stabilizer or to a carrier or other assembly to which the stabilizer is attached.

33 Claims, 5 Drawing Sheets

(56) References Cited

U.S. PATENT DOCUMENTS

| | | | | |
|---|---|---|---|---|
| 2009/0139664 | A1* | 6/2009 | Graichen | E06B 9/36 160/84.04 |
| 2013/0180670 | A1* | 7/2013 | Judkins | A47H 23/00 160/84.04 |

* cited by examiner

DRAPE HAVING STABILIZER

CROSS-REFERENCE TO RELATED APPLICATION

The present application claims priority to U.S. Provisional Application Ser. No. 62/039,211 which was filed on Aug. 19, 2014.

FIELD OF INVENTION

The invention relates to draperies used to cover windows and other architectural openings.

BACKGROUND OF THE INVENTION

Draperies are a well-known product used to cover a window or other opening. Drapes are typically made from a panel of fabric which is hung vertically from a rod or other support structure. The fabric may be woven or non-woven. In some drapes rings, snaps, or hooks may be used to attach the drapery material to the rod or to carriers on the rod. If carriers are used a cord may be provided for moving the carriers and attached drapery across the rod. Other drapes may have pockets, straps, loops or holes with grommets through which the rod passes.

When the drapery is in an open position the drapery material is stacked at one or both ends of the rod. A rule of thumb in the industry is that for every foot of window to be covered there will be four inches of stacked material when the drapery is in a fully open or stacked position. Drapery and curtains are rarely hung inside the window frame because the stacks would cover so much of the window. Consequently, the drapery rod must extend across the wall adjacent the window so that the stack of drapery material will not cover the window when fully opened. If sufficient wall space is not available for the stack, then even in a fully open position the drapery will obscure a portion of the window reducing the amount of light that can enter the room and limiting the view to the outside. It costs a significant amount of money for fabric, labor and hardware to cover the wall. The wall space covered by the drape cannot be used and furniture cannot be placed close to that wall space.

In my United States Published Patent Application No. 20130180670 A1 I disclose a drape made from a series of strips of material arranged side by side and attached together in a manner so that each pair of adjacent lengthwise sides of each strip when joined together form a tab. Each strip has a sharp lengthwise pleat substantially parallel to and between the sides of the strip such that the drape has a series of sharp folds projecting outward on the front of the drape and a series of tabs projecting outward from the back of the drape. This is a tighter stacking drapery than the drapes which are known in the art and available in the marketplace. This drape can form a tight stack when in a fully open position and has the soft fabric appearance of conventional drapes when in a drawn or unstacked position. This extremely small stack makes the drape comparable to other kinds of window coverings, such as cellular blinds which have small stacks and are often installed in the window casing.

Drapes open and close by moving side to side and, unlike most pleated shades, cellular shades, Roman shades and roll-up shades, drapes do not require lifting of material or holding a stack of material in place against gravity. But, when fully open, drapes cover a portion of the window, or a wall next to the window, from top to bottom. Drapery materials are preferred for many situations because they have a softer appearance and may naturally fold over when the drape is moved laterally to one side of the window when the drape is opened. However, such readily foldable materials tend to sag at the supports along the upper end of the drape. For this reason and for aesthetic purposes, i.e. to provide a more full appearance, draperies require stiffness along their upper end to prevent sagging at the supports. Stiffness has been provided to the upper end of drapery fabric by permanently affixing sections of materials, such as by sewing or gluing, to the upper end of the drapery fabric. Most often a continuous strip of material is sewn to the top of the drape in conjunction with a hem that may or may not wrap around the strip. Another method is to attach permanent extra sections of relatively stiff material between adjacent drapery fabric folds along the upper end of the drapery fabric. The extra strip or sections of material are collectively referred to as "the header" of the drape. In this way, the drapery fabric may still fold but will maintain an unfolded, bowed, "full" appearance between creases.

In my U.S. Pat. No. 5,765,260 I disclose a drape with a removable header and in my U.S. Pat. No. 5,857,511 I disclose a drape with heart-shaped headers. These headers are designed for drapes that are hung from carriers and are not particularly suited for drapes having holes, or holes with grommets, through the top portion of a drape. Yet another type of header is disclosed in my United States Published Patent Application No. 20130180670 A1.

Drapes, and particularly the drape disclosed in my United States Published Patent Application No. 20130180670, have a tendency to flare outward or toe out at the bottom when stacked. This is particularly noticeable when the drape is tightly stacked in the open position. When fully drawn across a window this drape tends to toe in at the bottom. Consequently, there is a need for a drape which can be tightly stacked and while in that stacked position will have a minimal or no outward flare and no toe in at the bottom of the stack when fully deployed.

SUMMARY OF THE INVENTION

I provide a drape having a longitudinal pocket at one side or both sides of the drape and a stiffening member or stabilizer in each pocket. The stabilizers are connected directly or indirectly to the drapery support track, rod or pole along which the drapery travels from an open stacked position to a closed unstacked position.

I prefer to provide a drape made from a series of strips of material arranged side by side and, attached together in a manner so that each pair of adjacent lengthwise sides of each strip when joined together form a tab. Each strip has a sharp lengthwise pleat substantially parallel to and between the sides of the strip such that the drape has a series of sharp folds projecting outward on the front of the drape and a series of tabs projecting outward from the back of the drape.

I further prefer to provide a wand on the exterior of the pocket and attached to the stabilizer or a carrier. I prefer to provide a hinge having one leaf attached to the stabilizer and the second leaf attached to the wand. I prefer to attach the wand to the second leaf by a screw or rivet such that the wand can rotate around an axis through the centerline of the screw or rivet. Connecting the wand to the stabilizer or carrier in this way provides two ranges of motion. The distal end of the wand can be moved in and out through one vertical plane relative to the drape by rotation around the screw or rivet. The wand can also be moved toward and away from the drape in a second vertical plane which intersects the first vertical plane by movement of the hinge.

DESCRIPTION OF THE PREFERRED EMBODIMENTS

Figure 1:
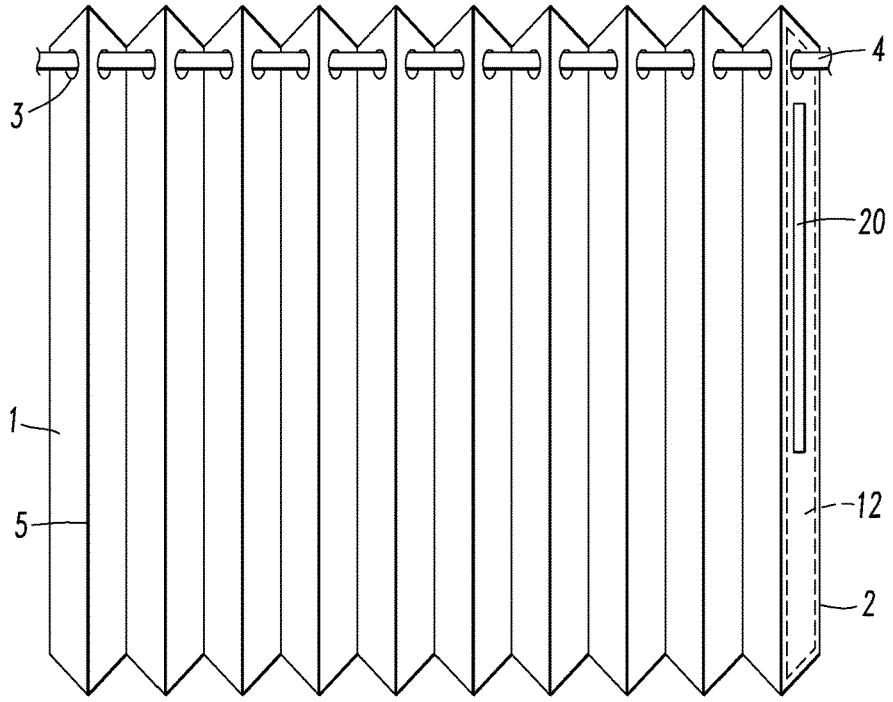
FIG. 1 is a front view of my drape in a fully drawn unstacked position.
Figure 2:
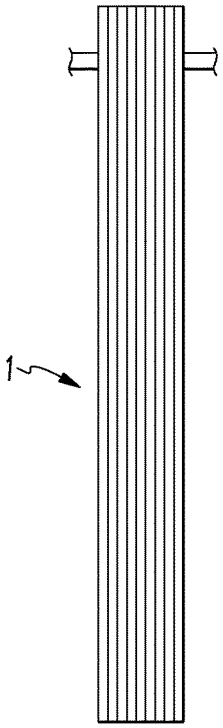
FIG. 2 is a front view illustrating how the drape would appear in a collapsed or stacked position.
Figure 3:
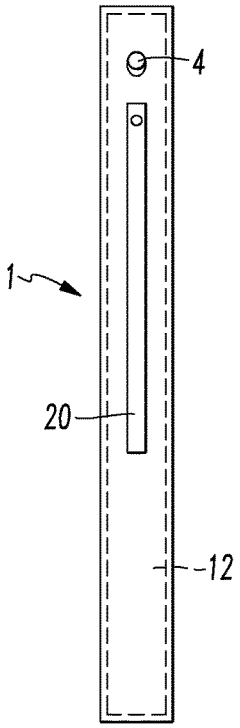
FIG. 3 is a side view of the drape shown in FIGS. 1 and 2 in which the wand is clearly visible.

Referring to FIGS. 1 through 6 a present preferred drape 1 consists of a panel of material having a series of spaced apart pleats. The panel may be a single piece of material or multiple pieces of material joined together. In one present preferred embodiment the panel consists of a series of folded strips 2 which have been attached together to create a pleated panel. Holes 3 may be provided at the top of the panel so that the drape can be fitted onto a support rod 4. I prefer that the holes be round and the support rod be oval with the major axis of the oval oriented vertically. Alternatively the holes could be oval. When the holes are oval with the minor axis in the vertical direction and the support rod is oval with the major axis in the vertical direction the drape rarely binds when unfolded along the rod. Each strip has substantially parallel longitudinal edges and is folded to create a sharp pleat 5 that is parallel to the longitudinal sides. If desired the fabric from which the strips are made can be a fabric like polyester that can have a crease permanently heat set or a material that can be treated with stiffening material that will help maintain this pleat. The edges of the strips are bonded together to form a series of rearward facing tabs 6. The advantages to providing sharp pleats include a very narrow stack and easier manufacturing, fabrication, packaging, storage and handling. The sharp pleats also provide a unique appearance.

Figure 4:
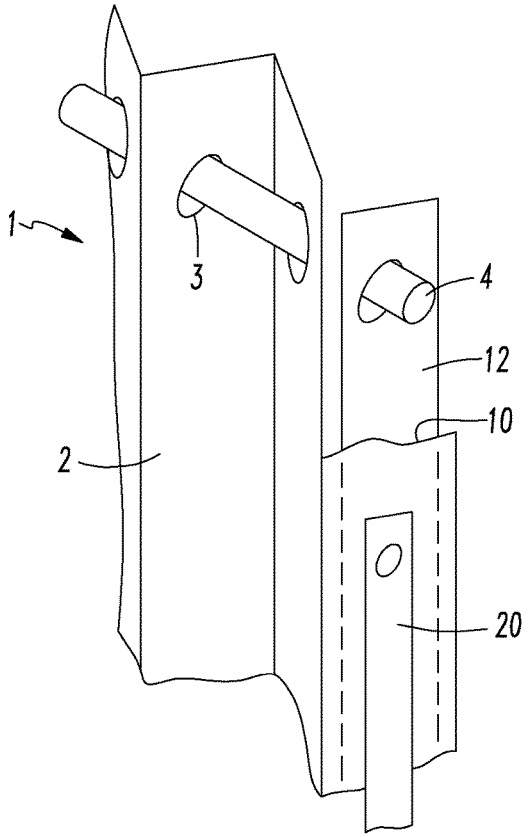
FIG. 4 is a perspective view partially cut away of the upper portion of the drape and wand that are seen in FIG. 3.

A pocket 10, shown most clearly in FIG. 4, is provided at one or both sides of the drape. The pocket can be formed by folding the material used to make the panel or end strip back on itself and bonding the free edge to the panel or strip. A stabilizer 12 is placed within the pocket 10 and may extend the entire length or nearly the entire length of the pocket. Rod 4 fits through a hole at the upper end of the stabilizer 12 so that the stabilizer is supported on the rod. The stabilizer 12 is not attached to the panel and is free to move within the pocket 10. I prefer that the width of the stabilizer 12 be smaller than the width of the pocket 10 so that the stabilizer fits loosely in the pocket. Alternatively, the stabilizer could be firmly connected to the top of the drape and then loosely connected everywhere else so that the drape is still free to expand and contract. While I prefer to provide a pocket that extends the full length of the drape and surrounds the stabilizer, a couple of shorter pockets can be used such that only the upper end and the lower end of the stabilizer are in the pockets. One could form the pocket with a strip of material such that the stabilizer passes through the pocket. The stabilizer may be made of vinyl, metal or particleboard and may be rigid or flexible. A weight may be provided at the bottom of the stabilizer. The weight of the stabilizer provides inertia to resist toe-ins and toe-outs. Adding weight to the bottom of the stabilizer can reduce the amount of toeing in and out at the bottom of the drape.

Figure 5:
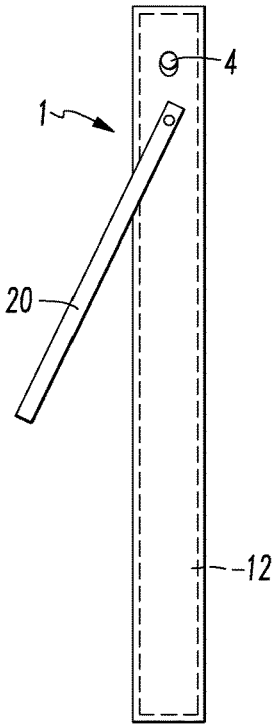
FIG. 5 is a side view similar to FIG. 3 showing the wand extended outward from the drape.
Figure 6:
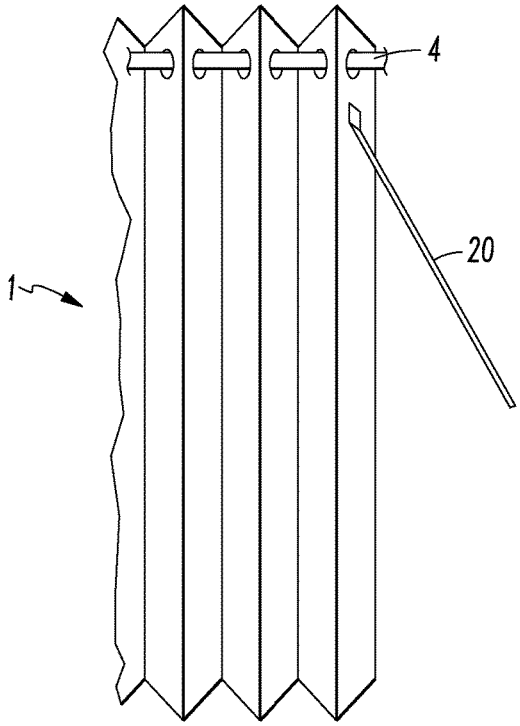
FIG. 6 is a front view similar to FIG. 2 showing the distal end of the wand extended upward away from the drape.
Figure 7:
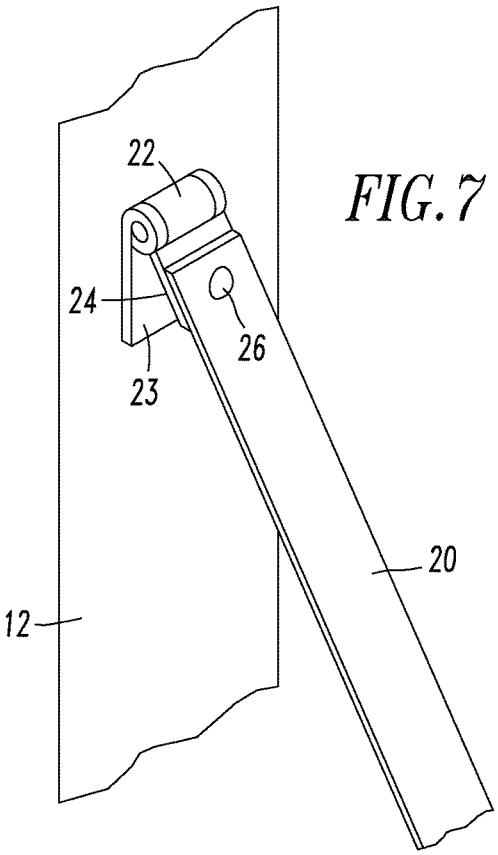
FIG. 7 is a fragmentary view of the top end of the wand connected to the stabilizer by a hinge.

I provide a wand 20 which is attached at its upper end to the stabilizer 12. Attachment of the wand near the top of the stabilizer provides better leverage. Although one could attach the wand to the stabilizer by a screw or rivet or hook and eye, I prefer to use a hinge 22 shown in FIG. 7. One leaf 23 of the hinge 22 is attached to the stabilizer 12 and the second leaf 24 is attached to the wand 20. Preferably the wand 20 is attached to the second leaf 24 by a screw or rivet 26 such that the wand 20 can rotate around an axis through the centerline of the screw or rivet. Connecting the wand to the stabilizer in this way provides two ranges of motion. As shown in FIG. 5 the distal end of the wand 20 can be moved outward through one vertical plane relative to the drape 1 by rotation around the screw or rivet 26. As shown in FIG. 6 the distal end of the wand 20 can also be moved and away from the drape 1 in a second vertical plane which intersects the first vertical plane by movement of the hinge 22. The wand could also be moved within the quadrant defined by these planes. This arrangement permits easy push or pulls of the drape and allows the operator to easily move the drape behind furniture that is between the drape and the operator.

Where the stabilizer is attached to a spacer at the top of the drape connecting the wand to the top of the stabilizer indirectly connects the wand to the spacer. One could alternatively connect the wand directly to the spacer. A most preferred method is to make a pre-molded stabilizer top assembly consisting of a molded piece that has a hole for the pole. A hinge is provided, and preferably molded into the top assembly, at a position immediately below the hole. Then the hole in the fabric is slightly enlarged to include the hinge. The hinge need not be hidden. Also this assembly can have a tab that extends out into the drape tab to connect to the spacer. The assembly can also have a molded hole for a centerline connection to a spacer and a molded hole for connection to a carrier. Finally, the assembly has a means to connect to the length portion of the stabilizer. The hinge would have been molded in the assembly. This assembly makes a strong connection to the wand, a relatively cheap hinge that can be any color, a strong connection to the spacer or carrier, and a smooth surface for sliding on the rod.

The wand hinge enables the user to twist the stabilizer by twisting the wand. This may be helpful when trying to position the side of the drape near a wall or beside another drape. Because of the strong creases and bonds, this drape works best with a butt overlap on center pulls. That is, a panel of drapery material is provided on each side of the window when the drape is open. To close the drape the panels are pulled together until they meet and overlap at the middle of the window. It is important that no light leaks through this overlap. The wands can tilt the stabilizer so that the back or window side edges touch. Magnets mounted on the stabilizers or on the edge of the drape hold the drape together while leaving space for the wands to hang near the centerline.

Alternatively, the wands could be mounted just inward of the stabilizer on the drapery side of each panel so that the wand is somewhat hidden by the panel and does not get in the way of the butt overlap. The hinge facilitates using this configuration too.

I prefer to make the wand 20 flat rather than round. By using a flat wand I am able to connect two drapery panels side to side in a manner so that the joint is not noticeable. The wand may be fiberglass, plastic or metal and should be rigid. I prefer to provide a fiberglass wand. One could provide a flap of fabric on the drape to cover the wand when the wand is not in use. This pocket is easy to make from an accordion folded material.

Figure 8:
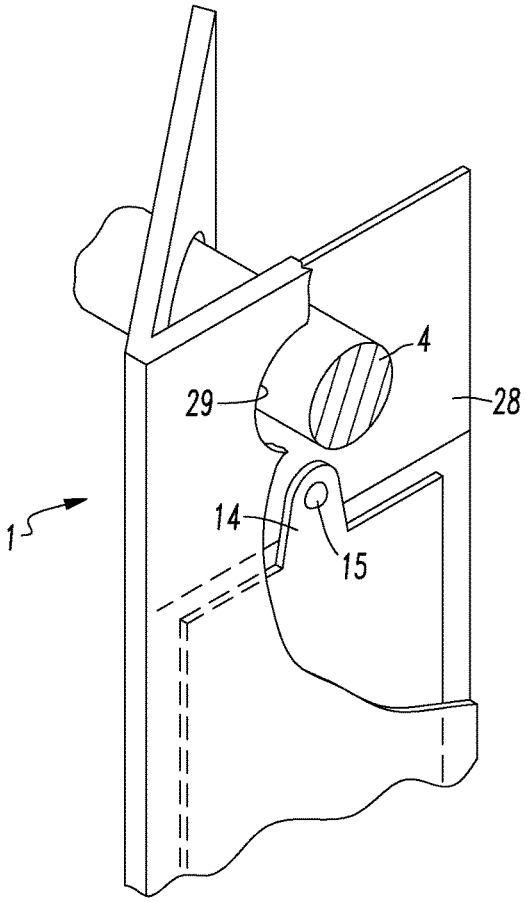
FIG. 8 is a perspective view partially cut away of the upper portion of a drape having a collar or header to which the stabilizer is attached.

In another present preferred embodiment illustrated by FIG. 8 a stiff collar or header 28 is attached to the drape 1 along the inside top inside edge of the panel of material. The collar 28 may be crinoline, cardboard, polypropylene or other stiff material which is bonded to the drape. I prefer to use an adhesive; but the collar 28 could be sewn to the drape or within a pocket along the top of the drape. Headers have been provided on drapes for decades and any known way to attach a header to a drape can be used. The rod 4 passes through a hole 29 in the collar 28 so that the collar is directly supported on the rod. In this embodiment the stabilizer 12 is attached to the collar 28 by at least one projection 14 that is attached to the collar by a rivet 15. This connection should be along a vertical line (not shown) passing through the center of gravity of the stabilizer 12. In this embodiment the stabilizer is not attached to the panel and is free to move within the pocket.

Figure 9:
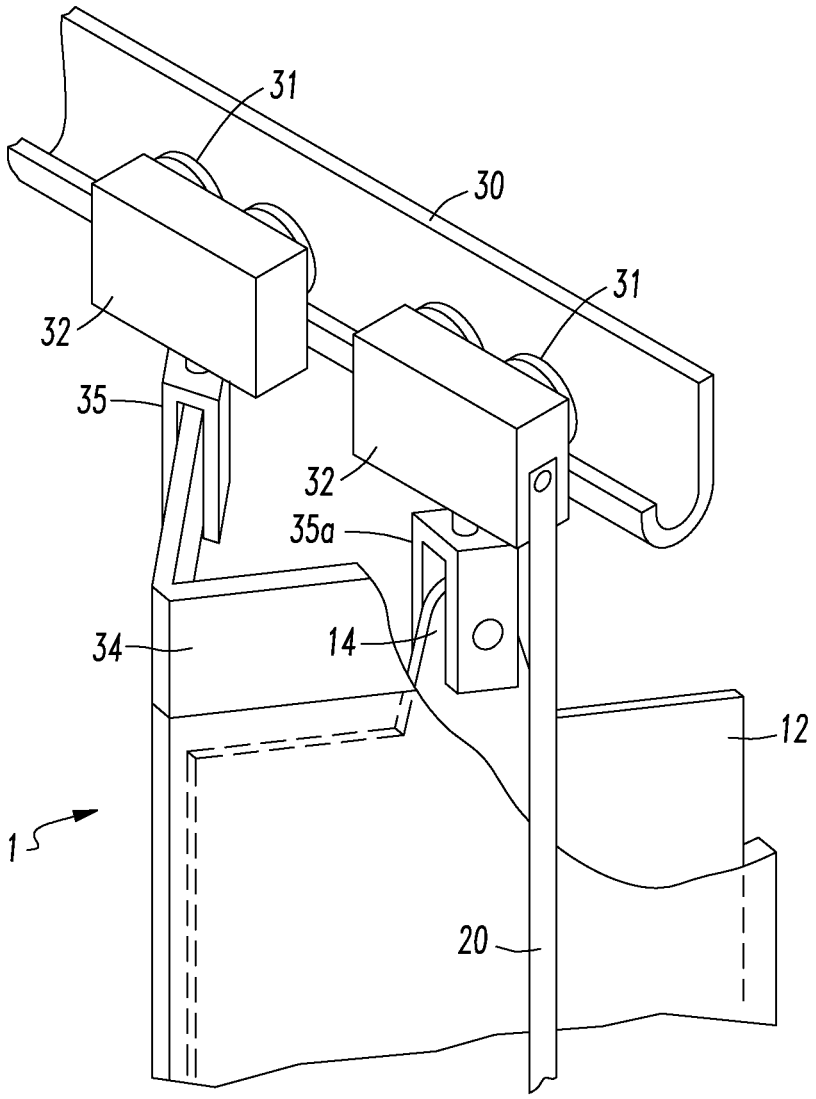
FIG. 9 is a perspective view similar to FIG. 8 of the upper portion of a drape hung on a track by carriers in which the stabilizer and the wand are attached to a carrier.

In yet another present preferred embodiment shown in FIG. 9 the drape 1 is hung on a track 30 by carriers 32. Each carrier has a wheel 31 or a pair of wheels that rides on the track. Each carrier may be attached to a header 34 that extends along the top edge of the drape by a clip 35. The stabilizer 12 may each be attached to one of the carriers 32 by the clip 35*a* at one side of the drape. The stabilizer 12 should be attached at its center of gravity so that the stabilizer hangs vertically or nearly vertically. If the stabilizer is not hung at or very close to its center of gravity the stabilizer may cause the bottom of the drape to flare toward or away from the room side of the drape. Once again in this embodiment the stabilizer is not attached to the panel and is free to move within the pocket. When carriers are used the wand 20 may be attached to the lead carrier as shown in FIG. 9. But, that type of connection is not preferred. One problem that occurs when the wand is attached to the carrier is twisting the wand does not twist the stabilizer.

When the stabilizer is attached to a carrier the attachment should allow the stabilizer to twist about a vertical axis. Then the wand should be attached to the stabilizer rather than the carrier to enable the wand to be used to twist the stabilizer as previously described. Attaching the wand to the stabilizer also enables the drape to be attached to the carrier in a manner so that the lead carrier is behind the leading edge of the panel. When the drape is attached to the carrier in this manner the leading edge of the drape can fit tightly to a wall or another panel.

Figure 10:
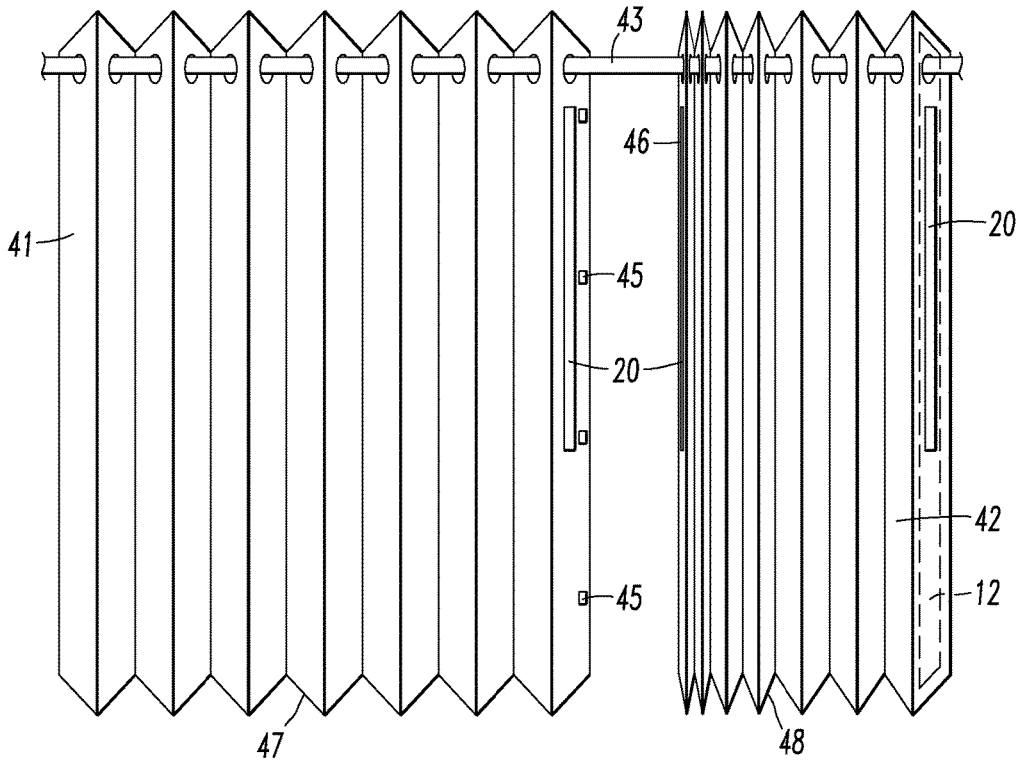
FIG. 10 is a front view of two drapes hung on a common rod being brought together for attachment to one another.

In yet another preferred embodiment shown in FIG. 10 I provide two drapery panels 41 and 42 on a common rod 43. A stabilizer 12 (indicated by broken lines) is provided in a pocket at the mating side of each drapery panel 41, 42 and a wand 20 is attached to each stabilizer. In this embodiment the wand is attached to the top of the stabilizer and the hole through the drapery material is enlarged to accommodate the hinge which attaches the wand to the stabilizer. A series of magnets 45 or a magnetic strip is provided along the window side edge of one panel 41 and a metal strip 46 is provided along the window side edge of the second drapery panel 42. One could provide a longitudinal fold line or hinge in the stabilizer and position the magnets on one side that line. This will allow the stabilizer to bend along that line when the magnets are engaged with a metal surface or another stabilizer. When these two edges are brought together magnetic attraction will keep them together. The wand 20 makes it easy to cant or tilt the edge of the panel having the magnets or the edge of the panel having the metal strip so that mating edges will come together easily. If desired, a similar arrangement of magnets or magnetic strip and metal strip may be provided on the room side edges of the drapery panels 41 and 42. If this is done in combination with magnets and a metal strip on the window side edges a pocket will be created between the two panels in which a wand 43, 44 from each panel is contained. Using flat wands makes this pocket less noticeable. Indeed the wands are barely noticeable when the two drapery panels are tightly stacked together in an open position and when the panels are drawn to a fully closed position.

Another advantage of using a flat wand is that a user of the wand can rotate the side of the drapery panels 41 and 42 to bring the magnets or magnetic strip in drapery panel 41 closer to the metal strip in drapery panel 42 when joining the two panels together.

In the embodiment shown in FIG. 10 magnets are provided to connect two panels of material together. Magnets may also be provided on or adjacent the stabilizer on the opposite sides of these panels to enable that side of the drape to be attached to a metal strip on a wall or window frame where that side is located when the drape is in an open position or closed position. One could also put screws or staples through the stabilizer to attach the drape to the wall or window frame.

A significant advantage of the drape with stabilizer over a similar drape without a stabilizer is that the bottom of the drape with a stabilizer will not flare out or toe in at the bottom as would occur in the same drape without a stabilizer. The stabilizer also provides greater control in moving the drape between open and closed positions. The bottom of the drape will not trail as far behind the top of the drape when the stabilizer is used.

Figure 11:
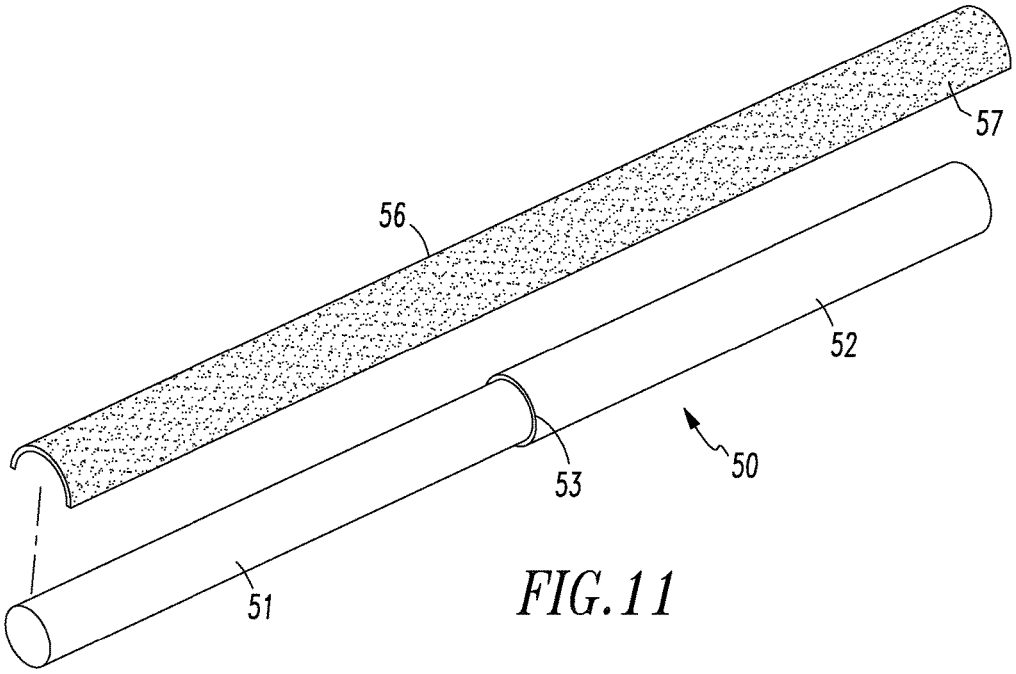
FIG. 11 is an exploded view of a telescoping rod and cover on which the drape can be hung.

Telescoping curtain rods and tracks are commonly used to hang curtains and draperies. In a telescoping rod, like rod 50 shown in FIG. 11, there is an inner rod 51 and an outer rod 52. The inner rod 51 has a smaller diameter than the outer rod and fits within the outer rod. Consequently, there is a step 53 where the inner rod 51 emerges from the outer rod 52. This step can cause the drapery to catch or get hung-up at the step as the user pulls the side of the drape from the smaller diameter rod 51 onto the larger diameter rod 52. To overcome the problem I prefer to provide a cover 56 that fits over the telescoping rod. This cover preferably is a plastic extrusion made from a flexible or rigid plastic material and does not telescope. A flexible plastic enables the cover to be rolled up for packaging and shipment and able to be made in a variety of colors. The cover should be thin enough so that the consumer can easily cut the cover, preferably with a pair of scissors or a razor knife or a fine hack saw blade. The front portion of the cover 57 may be textured and can even be covered with fabric. Because the drape rides on top of the rod, movement of the drape along the cover will not damage the textured or fabric surface.

While I have shown and described certain present preferred embodiments of my drape, my invention is not limited thereto but may be variously embodied within the scope of the following claims.

I claim:

1. A drape system comprising:

a drapery support;

a panel of material having a length, a width, a top edge, a front, a back, a first side edge, a second side edge opposite the first side edge, the panel having a series of spaced apart pleats and a single pocket, the single pocket positioned adjacent the first side edge of the panel, the panel connected to the drapery support in a manner which enables the panel to move along the drapery support from a closed, drawn position to an open, stacked position; and a stabilizer within the pocket, the stabilizer connected to the drapery support.

2. The drape system of claim 1 wherein the drapery support comprises a track and carriers which are attached to and move along the track, the panel attached to the carriers and the stabilizer attached to at least one carrier.

3. The drape system of claim 1 also comprising a header attached to the panel, the header being attached to the drapery support and the stabilizer being attached to the header.

4. The drape system of claim 1 wherein the drapery support system comprises a pole and the panel has a plurality of holes through which the pole passes.

5. The drape system of claim 4 also comprising a collar attached to the panel and surrounding one of the holes, and wherein the stabilizer is attached to the collar.

6. The drape system of claim 1 wherein the stabilizer has a top and the top is attached to the panel.

7. The drape system of claim 6 wherein only the top of the stabilizer is attached to the panel.

8. The drape system of claim 1 wherein the stabilizer is not attached to the panel and is free to move within the pocket.

9. The drape system of claim 1 also comprising a wand attached to the stabilizer.

10. The drape system of claim 9 also comprising a leaf hinge having a first leaf attached to the stabilizer and a second leaf attached to the wand the first leaf being moveable relative to the second leaf such that one end of the wand can be moved away from and toward the stabilizer.

11. The drape system of claim 10 also comprising a screw or rivet which connects the wand to the hinge.

12. The drape system of claim 9 wherein the wand is connected to the stabilizer in a manner such that a distal end of the wand can be moved in and out through one vertical plane relative to the panel and can also be moved toward and away from the panel in a second vertical plane which intersects the first vertical plane.

13. The drape of claim 9 wherein the wand is flat.

14. The drape system of claim 1 wherein the drapery support comprises a track and carriers which are attached to and move along the track and further comprising a wand having a first end and a second end, the first end attached to one of the carriers.

15. The drape system of claim 1 wherein the panel is comprised of a series of folded strips of material.

16. The drape system of claim 1 also comprising magnets attached to the panel along a window side edge of panel.

17. The drape system of claim 1 also comprising magnets attached to the panel along a room side edge of the panel.

18. The drape system of claim 1 also comprising a metal strip attached to the panel along a window side edge of the panel.

19. The drape system of claim 1 also comprising a metal strip attached to the panel along a room side edge of the panel.

20. The drape system of claim 1 wherein the stabilizer is flexible.

21. The drape system of claim 1 wherein the drapery support system comprises a telescoping rod and the panel has a plurality of holes through which the telescoping rod passes.

22. The drapery system of claim 21 also comprising a cover having a continuous outer surface having no steps which is fitted over the telescoping rod.

23. The drapery system of claim 22 wherein at least a portion of the outer surface of the cover is textured.

24. The drape system of claim 1 wherein the drapery support system comprises a pole and a plurality of oval rings through which the pole passes, the rings being attached to the panel.

25. The drape system of claim 1 also comprising a second panel connected to the drapery support in a manner which enables the second panel to move along the drapery support from a closed, drawn position to an open, stacked position.

26. The drape of claim 25 wherein the second panel has a first side edge, a second side edge opposite the first side edge, the second panel having a series of spaced apart pleats and a second panel longitudinal pocket positioned adjacent the first side edge of the second panel and further comprising a second panel stabilizer within the second panel longitudinal pocket.

27. The drape of claim 26 also comprising a second panel wand attached to the second panel stabilizer.

28. The drape system of claim 25 wherein the second panel is comprised of a series of folded strips of material.

29. The drape of claim 25 also comprising magnets attached to the second panel along a window side edge of the second panel.

30. The drape system of claim 25 also comprising magnets attached to the second panel along a room side edge of the second panel.

31. The drape system of claim 25 also comprising a metal strip attached to the second panel along a window side edge of the second panel.

32. The drape system of claim 25 also comprising a metal strip attached to the second panel along a room side edge of the second panel.

33. The drape system of claim 1 wherein the stabilizer has a longitudinal hinge or fold line.

* * * * *